US006921572B2

(12) United States Patent
Van Campen

(10) Patent No.: US 6,921,572 B2
(45) Date of Patent: Jul. 26, 2005

(54) TRANSMISSION BELTS COMPRISING A CORD WITH AT LEAST TWO FUSED YARNS

(75) Inventor: Jan Van Campen, Duiven (NL)

(73) Assignee: Teijin Twaron GmbH, Wuppertal (DE)

( * ) Notice: Subject to any disclaimer, the term of this patent is extended or adjusted under 35 U.S.C. 154(b) by 16 days.

(21) Appl. No.: 10/203,893

(22) PCT Filed: Feb. 13, 2001

(86) PCT No.: PCT/EP01/01623

§ 371 (c)(1),
(2), (4) Date: Nov. 21, 2002

(87) PCT Pub. No.: WO01/61091

PCT Pub. Date: Aug. 23, 2001

(65) Prior Publication Data

US 2003/0152757 A1 Aug. 14, 2003

(30) Foreign Application Priority Data

Feb. 16, 2000 (EP) ..... 00200544

(51) Int. Cl.[7] ..... B32B 25/10

(52) U.S. Cl. ..... 428/295.1; 428/36.1; 428/492; 156/137; 156/138; 156/139; 156/148; 156/910

(58) Field of Search ..... 428/36.1, 492, 428/521, 295.4, 295, 375, 378, 395, 222, 327, 423.9, 475.2, 480, 355; 525/133, 164; 524/346, 555, 808, 458; 156/338, 910, 96, 110.1, 124, 137, 138, 139, 148, 272.2, 275.5, 322, 325, 330; 264/428, 454, 495, 463

(56) References Cited

U.S. PATENT DOCUMENTS

| | | | | |
|---|---|---|---|---|
| 2,748,049 A | * | 5/1956 | Kalatus | 154/139 |
| 3,525,703 A | * | 8/1970 | Iwami et al. | 260/5 |
| 4,155,394 A | | 5/1979 | Shepherd et al. | |
| 4,460,029 A | * | 7/1984 | Schuetz et al. | 152/359 |
| 5,922,796 A | * | 7/1999 | Colombet et al. | 524/346 |

FOREIGN PATENT DOCUMENTS

| | | |
|---|---|---|
| EP | 0 602 618 A | 6/1994 |
| WO | WO 97/06297 | 2/1997 |

* cited by examiner

*Primary Examiner*—Merrick Dixon
(74) *Attorney, Agent, or Firm*—Oliff & Berridge, PLC

(57) ABSTRACT

A transmission belt is made of a cord, a rubber or thermoplastic matrix, and an adhesion material which is able to adhere the cord to the rubber or thermoplastic matrix. The cord is made of at least two yarns, such that a first yarn has a melting or decomposition point $T_1$ and a second yarn has a melting point $T_2$, wherein $T_1>T_2$. A ratio of a linear density of the first yarn to a linear density of the second yarn is between 1,000:1 and 1:1, wherein the second yarn is fused to the first yarn. A method of making such cords includes intertwining the first and the second yarn and then heating to a temperature between $T_1$ and $T_2$, with the heating step being integrated with or followed by a step wherein the cord is subjected to a dipping treatment with a rubber adhesion material.

17 Claims, 4 Drawing Sheets

TRANSMISSION BELTS COMPRISING A CORD WITH AT LEAST TWO FUSED YARNS

BACKGROUND OF THE INVENTION

1. Field of the Invention

The invention pertains to a transmission belt comprising a cord with at least two fused yarns, to a method of manufacturing the cord, and to a method of manufacturing the transmission belt.

2. Discussion of Related Art

Cords for reinforcing rubber articles are known in the art. A cord for that purpose comprising at least one high-modulus yarn and at least one low-modulus yarn is disclosed in WO 97/06297. The yarns of these cords may be twisted together and can be dipped with a rubber adhesive material. The low-modulus yarn is primarily added as a process aid to enable high-modulus yarns to be used in mould curing processes. By this method transmission belts can be produced; however, during the processing of such belts the mechanical properties of the cord tend to deteriorate.

High bundle cohesion is essential to avoid fraying when the belts get their final shape as they are cut out of a rubber composite slab. In order to produce a clean cut, all the filaments in the yam bundle have to be secured firmly together in the cutting plane. If they are not held in place, the applied cutting force can move filaments out of the cutting plane, causing filaments to be cut at different lengths (the effect called "fraying"). In order to meet the quality standards set by the belt industry, fraying must be kept to an absolute minimum, not for optical reasons only but also to prevent a possible failure initiation. For that reason both aramid and polyester cords are usually pre-dipped with a solvent-based MDI (diphenylmethane-4,4-diisocyanate) pre-dip to obtain high filament coherence. The pre-dipping with MDI results in a rather stiff cord with excellent cutting behavior, though at the cost of poor strength efficiency after the dipping process (10 to 20% strength loss compared to standard "soft-dipping"). Moreover, it was found that stiff-dipped p-aramid cords suffer from severe strength loss after handling and vulcanization. This strength loss is proportional to the stiffness (i.e. the degree of impregnation) and is presumably induced by kink bands while buckling the stiff aramid cords. This phenomenon resulting in loss of strength while handling or processing stiff-dipped cords is called "handling resistance" or "handleability".

SUMMARY OF THE INVENTION

It is an object of the present invention to manufacture transmission belt using cords with high bundle cohesion, having high strength efficiency and good adhesion while maintaining good handling resistance. This is particularly important for good cuttability behavior while producing open edge transmission belts.

BRIEF DESCRIPTION OF THE DRAWINGS

Other features of the present invention will become apparent as the following description proceeds and upon reference to the drawings, in which.

DESCRIPTION OF PREFERRED EMBODIMENTS

Figure 1:
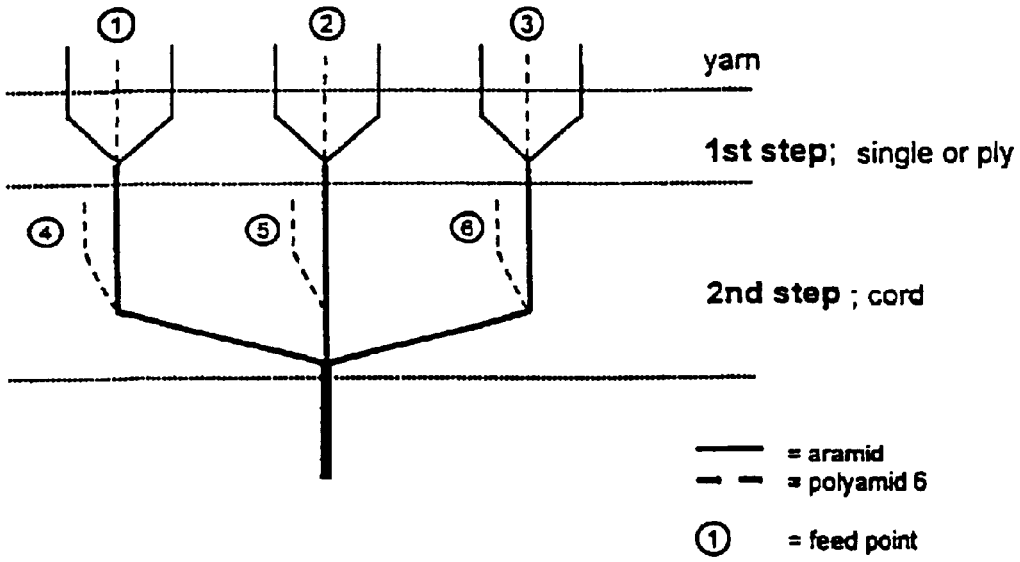
FIG. 1 is a schematic representation of a basic two-step twisting scheme.

The invention pertains to a transmission belt comprising a cord, a rubber or thermoplastic matrix, and an adhesion material which is able to adhere the cord to the rubber or thermoplastic matrix, wherein the cord is made up at least two yarns, the first being a yarn with a melting or decomposition point $T_1$, and the second being a yarn with a melting point $T_2$, wherein $T_1>T_2$ and the ratio of the linear density of the first yarn to the linear density of the second yarn is between 1,000:1 and 1:1, wherein the second yarn is fused to the first yarn.

Preferably, the ratio of the linear density of the first yarn to the linear density of the second yarn is between 100:1 and 4:1, and more preferably between 35:1 and 15:1.

For use in transmission belts the cord of the instant invention must contain a rubber or thermoplastic matrix adhesion material. Examples are chloroprene rubber (CR), hydrogenated butadiene acrylonitrile rubber (HNBR), alkylated chlorosulfonated polyethylene (ACSM), ethylene propylenediene rubber (EPDM), polyurethane (PU).

In order to ensure that in the transmission belt there is good adhesion of the cords to the matrix material of the belt, it is required to coat the cords with an adhesive. Therefore, the cords are treated with an adhesive system prior to being contacted with the matrix material. Preferably, the cords are provided with a first adhesive coating before they are treated with the rubber or the thermoplastic matrix adhesive material.

Highly suitable first adhesive coatings include epoxy compounds, polymeric methyl diphenyl diisocyanate (e.g., VORANATE® ex DOW), and polyurethanes having ionic groups.

The adhesive system also offers several options. Highly suitable for use in the case of, e.g., poly(para-phenylene terephthalamide) are a resorcinol/formaldehyde/latex (RFL) system and CHEMOSIL® (ex Henkel). In the case of, e.g., glass, use may be made of a silane compound.

The cord is particularly suitable for use in open-edge transmission belts, yet if the rubber adhesion treatment is omitted, the obtained cord is also suitable for use in other applications where high bundle cohesion is desired, such as in ropes, cables, hoses, and the like.

Highly suitable materials for yams with relatively high melting or decomposition points ($T_1$) include aromatic polyamides (aramid), such as poly(para-phenylene terephthalamide). Over the years these materials have proved especially suitable for use in composites. Aramid is frequently employed in composites with a rubber matrix among others. Other examples of appropriate materials are polyesters.

As suitable materials for yarns with relatively low melting points ($T_2$) may be mentioned polyesters, polyamides, polyolefins, elastodienes, elastanes, thermoplastic vulcanizates, and chlorofibres.

Some of these materials have been used in composites such as tires and drive belts for many years. Other examples of suitable materials are polyolefins, cellulose, acetate, acrylic material, and vinylal. The preferred yarn for transmission belt application is Perlon yarn 13—96 dtex (PA6 POY, melting point ±220° C.).

The method of manufacturing the cord of this invention comprises the steps of intertwining the first and the second yarn and then heating the intertwined cord at a temperature between $T_1$ and $T_2$, wherein the heating step is integrated with or followed by a step wherein the cord is subjected to a dipping treatment with a rubber adhesion material.

The heating step is performed to fixate the first yarn bundles by melting the second (fusion) yarn. The molten filaments embrace the single plies, thereby interlocking the filaments and holding them in place to enhance their cuttability.

The dipping treatment in order to prepare the cord for good adhesion to rubber or thermoplastic matrix is a well-known process. Depending on the basic cord yarn, a single- or two-bath dipping process can be used.

For technical and economical reasons, the fixation (heating) step ideally takes place during the dipping process. By selecting a thermoplastic adhesive with a melting point within the range of temperatures used for the dipping treatment, the heat setting can be combined with the dip-curing steps. By selecting a thermoplastic adhesive with a melting point between 200–250° C., the heat-setting can be combined with the curing step in a conventional dipping process. Integrated RFL dipping and heat setting is the preferred method for the production of aramid cords for transmission belts.

The method can be applied to any cord construction; however, typical applications are cord constructions with a linear density ranging from 210 to 50,000 dtex. A typical construction for transmission belt application is TWARON® 2300 1680 dtex×2 Z190×3 S115 (linear density: 1680×2×3=10080 dtex).

The distribution of the second (fusion) yarn is controlled by intertwining the fusion yarn according to appropriate twisting schemes and is dependent on the type of cord construction. The twisting scheme and the amount of fusion yarn relative to the first yarn used depend on the desired bundle cohesion and are easily determined by those skilled in the art. Twisting regimens are well-known in the art. The twisting can be carried out with any suitable twisting equipment.

Figure 2:
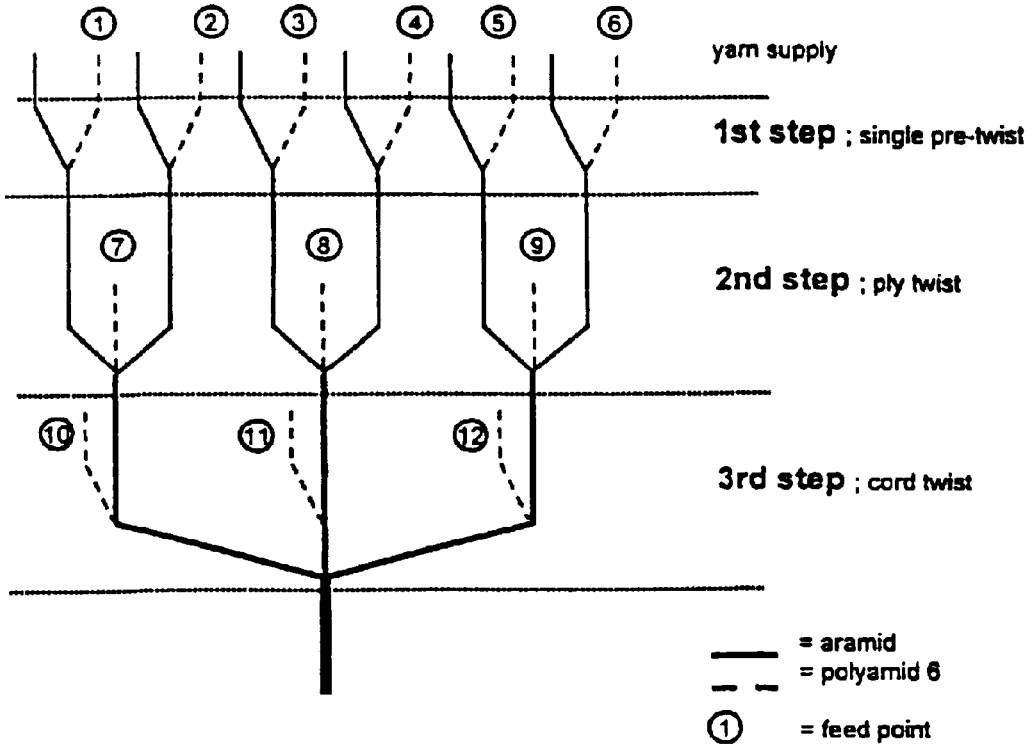
FIG. 2 is a schematic representation of a basic three-step twisting scheme.

In order to distribute the adhesive for this cord, one can apply several twisting schemes, depending on the complexity of the cord construction. For TWARON® 2300 1680 dtex×2 Z190×3 S115 construction, for instance, a basic two-step twisting a scheme I or a basic three-step scheme II can be used. The distribution of adhesive is controlled by varying the number of feed points and the positions where the fusion yarn is fed into the aramid construction. When using a two-step basic twisting scheme, there are 6 feeding positions, with 12 different twisting scheme possibilities in total. See FIG. 1. If a three-step basic twisting positions scheme is used, there are 12 feeding positions, with 72 different twisting scheme possibilities in total. See FIG. 2.

Figure 3:
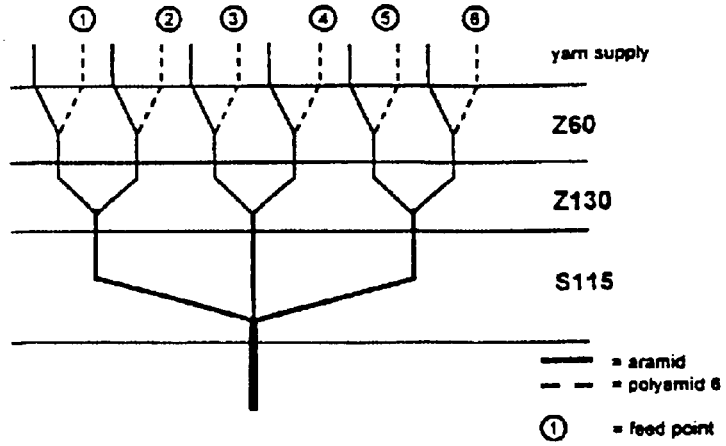
FIG. 3 is a schematic representation of a preferred method of twisting a typical construction for a transmission belt application and of the three-step twisting scheme of Example 4F.

The preferred method of twisting a typical construction for transmission belt application is shown in FIG. 3.

The invention is further illustrated by the following examples.

EXAMPLE 1

Dipping Conditions

For a typical aramid construction for transmission belt application the following dipping conditions are chosen.

| | |
|---|---|
| Two-bath procedure: Pre dipping conditions. | |
| dip: | T03 (2%) GE100 epoxide |
| oven 1 | |
| residence time: | 120 sec |
| temperature: | 150° C. |
| tension: | 25 N |
| RFL dipping conditions | |
| dip: | VP latex A11 (25%) |
| oven 2 | |
| residence time: | 120 sec |
| temperature: | 150° C. |
| tension: | 25 N |
| oven 3 | |
| residence time: | 60 sec |
| temperature: | 235° C. |
| tension: | 25 N |
| One-bath procedure: RFL dipping conditions | |
| dip: | VP latex A11 (25%) |
| oven 1 | |
| residence time: | 120 sec |
| temperature: | 150° C. |
| tension: | 25 N |
| oven 2 | |
| residence time: | 60 sec |
| temperature: | 235° C. |
| tension: | 25 N |

Figure 4:
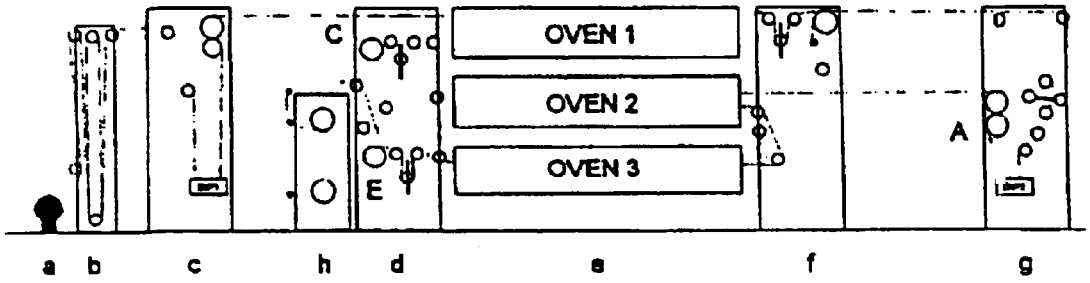
FIG. 4 is a schematic representation of a Litzler laboratory dipping unit.

The dip treatment was carried out on a Lizler laboratory dipping unit according to the known art of the two-bath-three-oven dipping procedure as shown in FIG. 4. The greige cord was reeled off at position a. The GE-100 pre-dip was applied by submerging the cord in a dip container at position c and subsequently curing it in oven 1. The RFL dip was applied a position g and was subsequently dried and cured in oven 2 and oven 3, respectively. At position h, the dipped cord was wound on a spool. The dipping speed and the tension were maintained at a constant level by the control units c, d, f, and g.

Preparation of T03 (2%) GE100 epoxide

To 978.2 g of demin (demineralized) water in a polyethylene bottle, 0.5 g of piperazine was added, and the mixture was stirred with a glass rod until the solids were dissolved. Under stirring with the glass rod, 1.3 g of AEROSOL™ OT 75% (surfactant dioctyl sodium sulfosuccinate in 6% ethanol and 19% water) (Chemical Corporation Pittsburgh, Pa., USA) were added, and thereafter 20.0 g of GE-100 epoxide (mixture of di- and trifunctional epoxide on the basis of glycidyl glycerin ether (Raschig AG, Ludwigshafen, Germany) were added. The mixture was stirred mechanically during 1 min and the preparation was matured for 12 h at room temperature.

The storage life of this dip was five days in a refrigerator between 5–10° C.

Formulation RFL Dip A11

Preparation:

A mixture of 275.3 g of demin water, 12.9 g of ammoniumhydroxide 25%, and 69.4 g of PENACOLITER® R50 50% (recorcinol-formaldehyde polymer resin solution) (Chemical Corporation Pittsburgh, Pa. USA) was added to PLIOCORD® VP106 (aqueous dispersion of a vinylpyridene-styrene-butadiene terpolymer (40%)) (Goodyear Chemicals, Europe, Les Ulis, France) and stirred during 3 min. A mixture of 23.1 g of formaldehyde 37% and 110.6 g of demin water was added and stirred for another 3 min. The dip was matured for 12 h at room temperature.

The storage life of this dip is five days in a refrigerator between 5–10° C.

EXAMPLE 2

The properties of the cords were measured as specified in document IN97/7180, "Standard methods of testing Twaron filament yarns and cords", version 4, 01-01-1997 of Twaron Products. For tensile test methods reference is made to ASTM D885—"Standard Test Methods for Tire cords, Tire Cord Fabrics, and Industrial Filament Yarns" —and EN 12562—"Para-aramid multi filament yarns—Test methods".

The mechanical properties are listed in Table 1, comparing:several dip-treated aramid cords samples.

Stiff Dipped:

a) MDI (2.5%)/A11 (20%): aramid cord dip-treated with pre-dip-containing 2.5% MDI and RFL dip-treatment A11 (20%).
b) MDI (5%)/A11 (20%): aramid cord dip-treated with pre-dip-containing 5% MDI and RFL dip-treatment A11 (20%).
c) MDI (10%)/A11 (20%): aramid cord dip-treated with pre-dip-containing 10% MDI and RFL dip-treatment A11 (20%).

Soft Dipped:

d) T03 (0.5%)/A11 (25%): newly developed aramid cord with thermoplastic impregnation treated with pre-dip-containing 0.5% GE100 epoxide and RFL dip-treatment A11 (25%).
e) T03 (0.5%)/A11 (25%): aramid cord dip-treated with pre-dip-containing 0.5% GE100 epoxide and RFL dip-treatment A11 (25%).
f) T03 (1 %)/A11 (25%): newly developed aramid cord with thermoplastic impregnation treated with pre-dip-containing 1 % GE100 epoxide and RFL dip-treatment A11 (25%).
g) T03 (1 %)/A11 (25%): aramid cord dip-treated with pre-dip-containing 1 % GE100 epoxide and RFL dip-treatment A11 (25%).
h) T03 (2%)/A11 (25%): newly developed aramid cord with thermoplastic impregnation treated with pre-dip-containing 2% GE100 epoxide and RFL dip-treatment A11 (25%).
i) T03 (2%)/A11 (25%): aramid cord dip-treated with pre-dip-containing 2% GE100 epoxide and RFL dip-treatment A11 (25%).

The following properties were measured according to internal procedures.

Dip Eff.-Absolute dip efficiency absolute=percentage retained strength of cord after dip treatment relative to the absolute breaking strength of the untreated greige cord.

Calculation:

$$\frac{\text{Absolute breaking strength dipped cord(N)}}{\text{Absolute breaking strength greige cord(N)}} \times 100\ (\%)$$

Strap Peel Force

Adhesion test according ASTM D4393 using a) CR compound=chloroprene rubber compound and
b) NR compound=natural rubber compound Dunlop 5320.

Handle Ret. Strength

Handleability retained strength=absolute retained strength after vulcanization and manual handling.

Handleability retained strength is measured after cords are extracted from a vulcanized rubber composite. Since this procedure not only includes a vulcanization process but also a portion of severe manual handling (bending, buckling and kinking), the retained strength is also referred to as the ability to handle resistance or "handleability".

Handleability Retained Strength Test Procedure

Cords are embedded between two layers of DUNLOP 5320 NR rubber compound of 1–2 mm thickness in a form of 440 mm length, 190 mm width. The longitudinal cord layer (pitch 10 ends per inch (2.54 cm)) is maintained in the central position. while the composite is preformed and vulcanized in a mold at 160° C. during 20 to 30 min. After cooling, the obtained slab is divided into straps of 1-inch (2.54 cm) width. From each strap, individual cord amples are extracted by hand. While one end of the strap is clamped in a vice, incisions between the cords are made at the other end of the strap. The cords are then separated by being torn at an angle >90° away from the strap. The retained tensile strength of at least six extracted cords is measured (omitting the outer cords of each strap).

Handle Perc. Ret. Strength

Handleability percentage retained strength=percentage of retained strength after vulcanization and manual handling relative to the absolute breaking strength of the dip treated cord.

$$\frac{\text{Absolute retained strength after vulcanization and manual handling } (N)}{\text{Absolute breaking strength of dipped cord } (N)} \times 100\,(\%)$$

TABLE 1

Tensile properties of Twaron 2300 development constructions.

| Cord construction | | | Twaron 2300 1680 x2 Z190 x3 S115 | | | | | | | | |
|---|---|---|---|---|---|---|---|---|---|---|---|
| Dip treatment | | | stiff dipping | | | soft dipped | | | | | |
| Dip conditions | recipe pre-dip<br>recipe RFL dip | | MDI (2.5%)<br>A11 (20%) | MDI (5%)<br>A11 (20%) | MDI (10%)<br>A11 (20%) | T03 (5%)<br>A11 (25%) | | T03 (1%)<br>A11 (25%) | | T03 (2%)<br>A11 (25%) | |
| Cord sample<br>Description | | unit | a<br>$\bar{X}$ | b<br>$\bar{X}$ | c<br>$\bar{X}$ | d<br>$\bar{X}$ | e<br>$\bar{X}$ | f<br>$\bar{X}$ | g<br>$\bar{X}$ | h<br>$\bar{X}$ | i<br>$\bar{X}$ |
| Breaking strength | | N | 1615 | 1643 | 1650 | 2061 | 2000 | 2003 | 1978 | 1796 | 1885 |
| Elongation at break | | % | 3.8 | 3.8 | 3.7 | 4.3 | 4.2 | 4.2 | 4.2 | 4.0 | 4.1 |
| Force at specified elongation 1% | | N | 372 | 381 | 392 | 398 | 389 | 393 | 397 | 380 | 397 |
| Force at specified elongation 2% | | N | 779 | 801 | 827 | 876 | 850 | 868 | 868 | 820 | 842 |
| Force at specified elongation 3% | | N | 1239 | 1269 | 1301 | 1379 | 1350 | 1375 | 1367 | 1307 | 1331 |
| Dip efficieny absolute | | % | 78.8 | 80.1 | 80.4 | 96.8 | 93.1 | 94.0 | 92.3 | 84.2 | 88.5 |
| Strap peel force | CR compound | N/2 cm | — | — | — | 194 | 235 | 189 | 235 | — | — |
| Strap peel force | NR compound | N/2 cm | — | — | — | 222 | 294 | 221 | 287 | 247 | 270 |
| Handle.ret strength | | N | 1390 | 1250 | 1120 | 1866 | 1880 | 1890 | 1850 | — | — |
| Handle.perc.ret strength | | % | 86.1 | 76.1 | 67.9 | 90.5 | 94.0 | 94.4 | 93.5 | — | — |

EXAMPLE 3

Cord Constructions of Two-step Twisting (BISFA notations)

A: ((TWARON 2300 1680 dtex×2+PA6 44 dtex)×1 Z190+(2×(TWARON 2300 1680 dtex×2 Z190)))S115.

Figure 5:
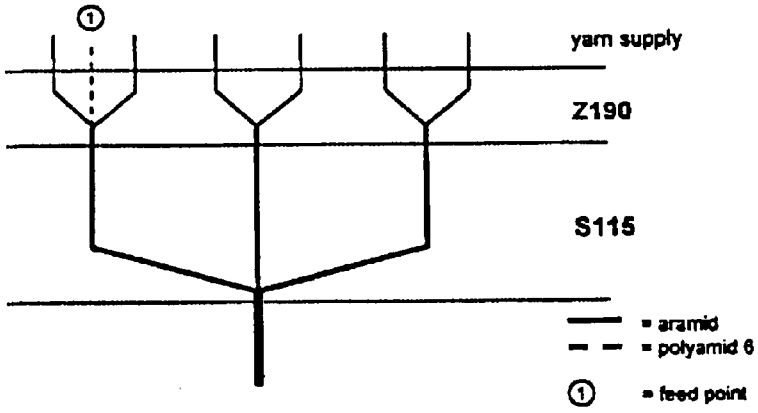
FIG. 5 is a schematic representation of a two-step twisting scheme of Example 3A.

The schematic view of Example 3A is shown in FIG. 5.

B: B: (2×(TWARON 2300 1680 dtex×2+PA6 44 dtex)×1 Z190)+TWARON 2300 1680 dtex×2 Z190)S115.

Figure 6:
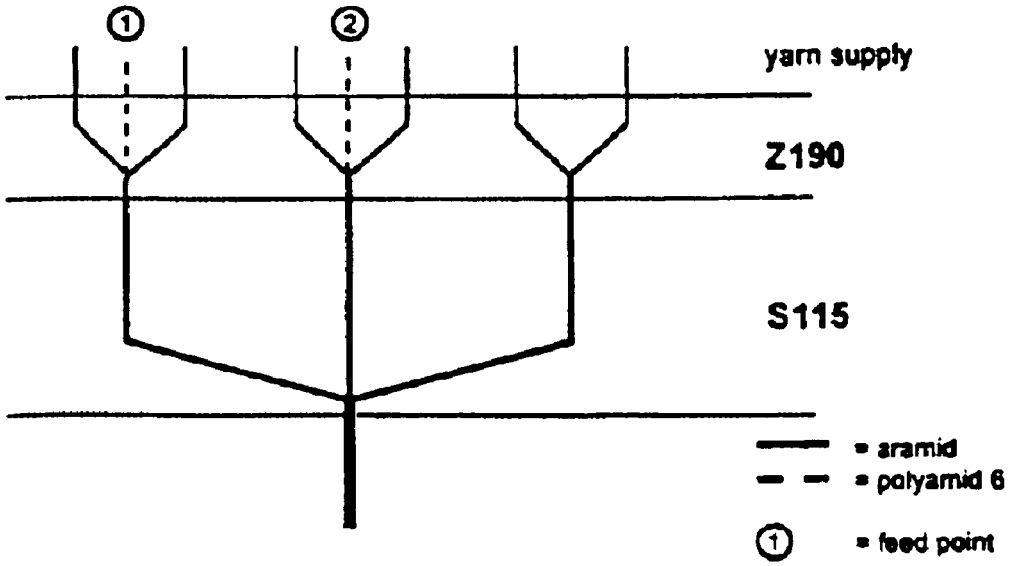
FIG. 6 is a schematic representation of a two-step twisting scheme of Example 3B.

The schematic view of Example 3B is shown in FIG. 6.

C: (TWARON 2300 1680 dtex×2+PA6 44 dtex)×1 Z190×S115.

Figure 7:
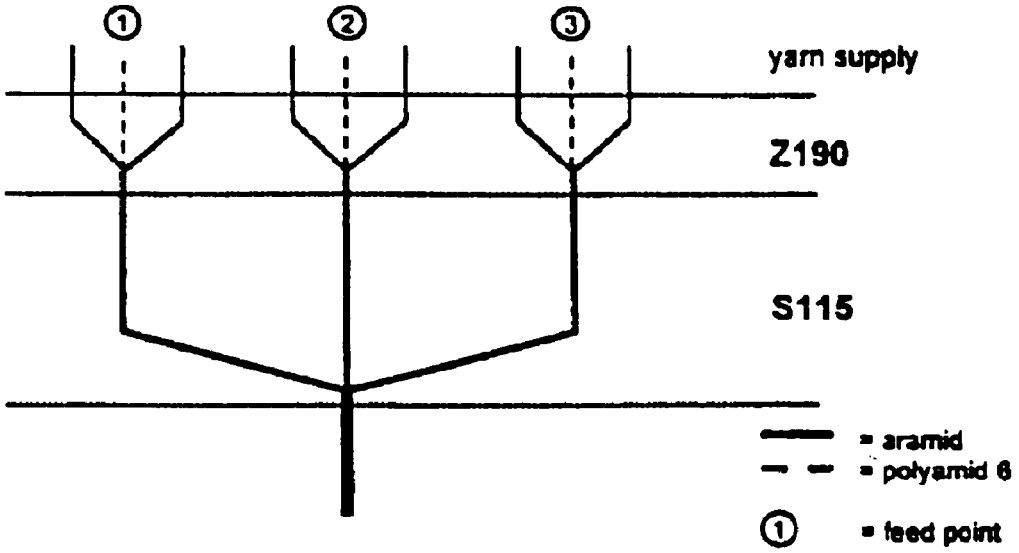
FIG. 7 is a schematic representation of a two-step twisting scheme of Example 3C.

The schematic view of Example 3C is shown in FIG. 7.

EXAMPLE 4

Cord Constructions of Three-steps Twisting (BISFA notations)

Figure 8:
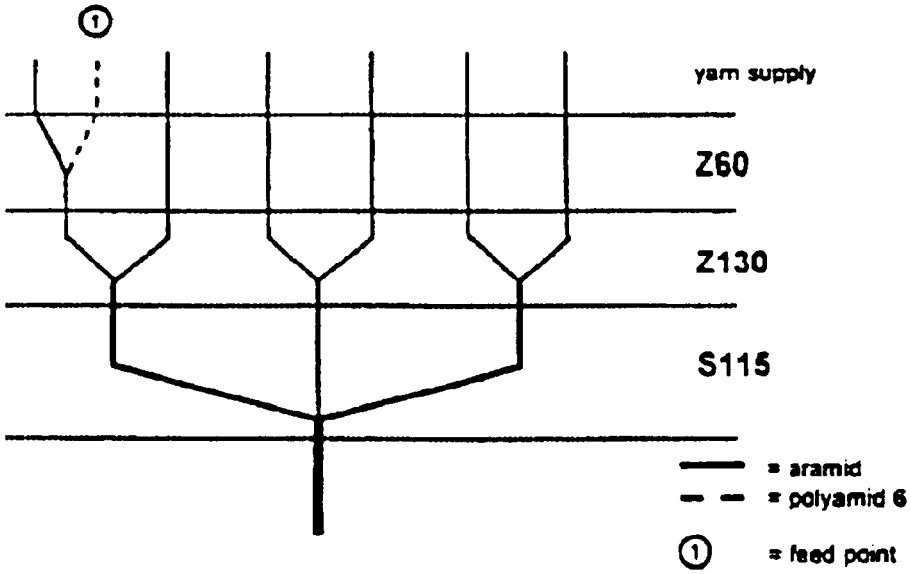
FIG. 8 is a schematic representation of a three-step twisting scheme of Example 4D.

D: ((TWARON 2300 1680 dtex+PA6 44 dtex)+TWARON 2300 1680 dtex Z60)Z130+(2x(TWARON 2300 1680 dtex Z60×2 Z130))S115;

The schematic view of Example 4D is shown in FIG. 8.

Figure 9:
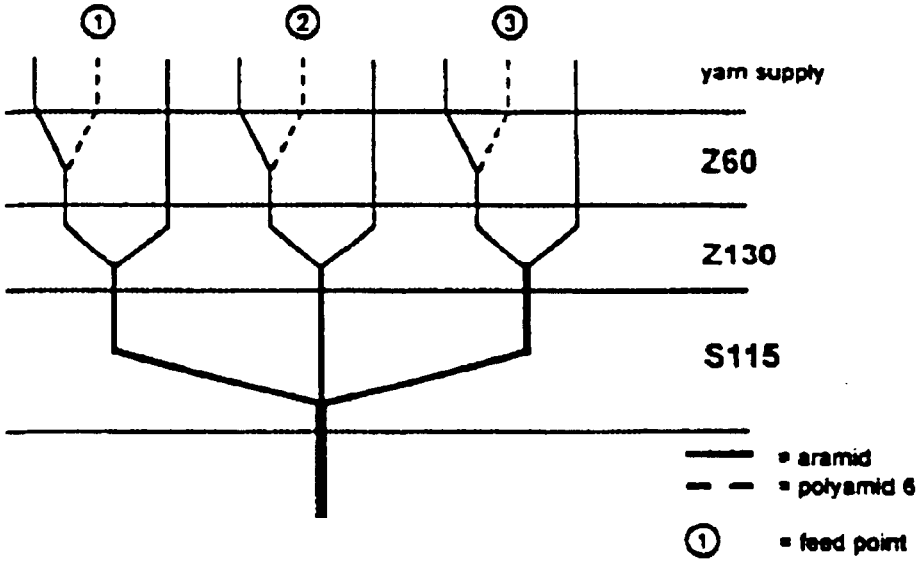
FIG. 9 is a schematic representation of a three-step twisting scheme of Example 4E.

E: (TWARON 2300 1680 dtex+PA6 44 dtex)Z60+TWARON 2300 1680dtex Z60)Z130×3 S115;

The schematic view of Example 4E is shown in FIG. 9.

F: (TWARON 2300 1680 dtex ×2+PA6 44 dtex)Z60×2 Z130×3 S115.

The schematic view of Example 4F is shown in FIG. 3.

What is claimed is:

1. A transmission belt comprising a cord, a rubber or thermoplastic matrix, and an adhesion material able to adhere the cord to the rubber or thermoplastic matrix, wherein the cord comprises at least two yarns, a first yarn having a melting or decomposition point $T_1$ and a second yarn having a melting point $T_2$, wherein $T_1>T_2$ and a ratio of a linear density of the first yarn to a linear density of the second yarn is between 1,000:1 and 1:1, and wherein the second yarn is fused to the first yarn.

2. The transmission belt of claim 1, wherein the first yarn is an aramid or polyester yarn.

3. The transmission belt of claim 1, wherein the rubber or thermoplastic matrix is a rubber matrix and the adhesion material is a resorcinol/formaldehyde/latex system.

4. A method of manufacturing a cord comprised of at least two yarns, a first yarn having a melting or decomposition point $T_1$ and a second yarn having a melting point $T_2$, wherein $T_1>T_2$ and a ratio of a linear density of the first yarn to a linear density of the second yarn is between 1,000:1 and 1:1, and wherein the second yarn is fused to the first yarn, comprising:

intertwining the first and the second yarn;

heating the intertwined first and second yarn to a temperature between $T_1$ and $T_2$; and dipping with an adhesion material able to adhere the cord to a rubber or thermoplastic matrix, wherein the heating is conducted before or during the dipping.

5. A method of manufacturing a transmission belt comprising adhering the cord obtained by the method of claim 4 to a rubber or thermoplastic matrix.

6. The transmission belt according to claim 1, wherein the ratio of a linear density of the first yarn to a linear density of the second yarn is between 100:1 and 4:1.

7. The transmission belt according to claim 1, wherein the ratio of a linear density of the first yarn to a linear density of the second yarn is between 35:1 and 15:1.

8. The transmission belt according to claim 1, wherein the rubber or thermoplastic matrix is selected from the group consisting of chloroprene rubber (CR), hydrogenated butadiene acrylonitrile rubber (HNBR), alkylated chlorosulfonated polyethylene (ACSM), ethylene propylenediene rubber (EPDM) and polyurethane (PU).

9. The transmission belt according to claim 1, wherein the adhesion material is selected from the group consisting of epoxy compounds, polymeric methyl diphenyl diisocyanate and polyurethanes having ionic groups.

10. The transmission belt according to claim 1, wherein the second yarn is selected from the group consisting of polyesters, polyamides, polyolefins, elastodienes, elastanes, thermoplastic vulcanizates, chlorofibers, cellulose, acetate, acrylic material and vinylal.

11. The transmission belt according to claim 1, wherein the first yarn and the second yarn are intertwined.

12. The method of manufacturing a cord according to claim 4, wherein the heating is integrated with the dipping.

13. The method of manufacturing a cord according to claim 4, wherein the heating is performed before the dipping.

14. The method of manufacturing a cord according to claim 4, wherein the ratio of a linear density of the first yarn to a linear density of the second yarn is between 100:1 and 4:1.

15. The method of manufacturing a cord according to claim 4, wherein the ratio of a linear density of the first yarn to a linear density of the second yarn is between 35:1 and 15:1.

16. The method of manufacturing a cord according to claim 4, wherein the intertwining of the first yarn and the second yarn is performed as a three-step twisting scheme.

17. The method of manufacturing a cord according to claim 4, wherein the intertwining of the first yarn and the second yarn is performed as a two-step twisting scheme.

* * * * *

UNITED STATES PATENT AND TRADEMARK OFFICE

CERTIFICATE OF CORRECTION

PATENT NO. : 6,921,572 B2
DATED : July 26, 2005
INVENTOR(S) : Jan Van Campen

It is certified that error appears in the above-identified patent and that said Letters Patent is hereby corrected as shown below:

Column 1,
Line 20, change “mould” to -- mold --.
Line 55, insert -- a -- before “transmission”.

Column 2,
Line 29, change “up” to -- of --.
Line 46, insert -- and -- before “polyurethane”.
Between lines 65 and 66, insert the following paragraph:
-- Preferred rubber adhesion materials are the ones based on recorcinol/formaldehyde latex systems. --.

Column 3,
Line 4, change “yams” to -- yarns --.
Line 16, change “chlorofibres” to -- chlorofibers --.

Column 4,
Line 5, after “twisting” delete “a”.
Line 11, after “twisting” delete “positions”.
Line 58, change “Lizler” to -- Litzler --.
Line 65, change “a” to -- at --.

Column 5,
Line 45, after “ing” delete “:”.

Signed and Sealed this

Twenty-seventh Day of September, 2005

JON W. DUDAS
*Director of the United States Patent and Trademark Office*